US007203979B2

(12) United States Patent
O'Brien

(10) Patent No.: US 7,203,979 B2
(45) Date of Patent: Apr. 17, 2007

(54) DECONTAMINATION GATE APPARATUS

(76) Inventor: T. Darren O'Brien, 213 Lenmore Dr., Concord, NC (US) 28025

( * ) Notice: Subject to any disclaimer, the term of this patent is extended or adjusted under 35 U.S.C. 154(b) by 198 days.

(21) Appl. No.: 10/811,217

(22) Filed: Mar. 26, 2004

(65) Prior Publication Data

US 2005/0210578 A1 Sep. 29, 2005

(51) Int. Cl.
*A47K 3/28* (2006.01)

(52) U.S. Cl. ..... 4/900; 4/599; 4/615; 239/279; 239/280

(58) Field of Classification Search ..... 4/567, 4/599, 601, 612, 615–617, 620, 900; 239/269, 239/279, 280, 282, 283
See application file for complete search history.

(56) References Cited

U.S. PATENT DOCUMENTS 3,170,171 A * 2/1965 Mayhew et al. ..... 4/615
3,288,109 A 11/1966 Smith et al.
4,848,383 A * 7/1989 Buhler ..... 134/123
4,858,256 A 8/1989 Shankman
4,961,535 A * 10/1990 Skibik ..... 239/279
5,223,757 A 6/1993 Staub et al.
5,469,587 A * 11/1995 Demeny ..... 4/599
5,759,289 A * 6/1998 Caron et al. ..... 134/34
5,797,722 A 8/1998 Sasaki et al.
5,913,477 A * 6/1999 Dean ..... 239/280
6,446,277 B1 * 9/2002 Blomet ..... 4/596
6,470,512 B1 10/2002 Lau et al.
6,554,013 B2 4/2003 Brown
6,745,414 B2 * 6/2004 Zhou ..... 4/900
2002/0021985 A1 2/2002 Peterson et al.
2003/0037812 A1 2/2003 Stewart et al.
2003/0074845 A1 4/2003 Sample et al.

FOREIGN PATENT DOCUMENTS

FR 2857607 A1 * 1/2005

* cited by examiner

*Primary Examiner*—Tuan Nguyen
(74) *Attorney, Agent, or Firm*—Clements Walker; F. Rhett Brockington

(57) ABSTRACT

An improved combination security and decontamination gate to be used at various venues and areas which entertain large numbers of people. The gates may be set up at entrance and exit areas of the venue or area for security purposes, as well as to facilitate quick and thorough decontamination of as many people and objects as possible in the event of an emergency. The gate contains a plurality of liquid conduits and spray heads and can be mounted on a variety of surfaces.

5 Claims, 6 Drawing Sheets

DECONTAMINATION GATE APPARATUS

FIELD OF THE INVENTION

The present invention is directed to a combination security and decontamination gate, particularly for large venues and areas.

Since the attack on the World Trade Center, Americans have become increasingly aware of the potential for large numbers of people to be exposed to hazardous material. In the event of an exposure, people must be decontaminated as soon as possible to minimize the health risk. The conventional method for decontaminating crowds is by spraying water from fire trucks. This method is slow and ineffective for use with large crowds. The present invention is a combination security and decontamination gate, useable at various venues and areas which entertain large numbers of people. The gate may be set up at entrance and exit areas of the venue for security purposes, as well as to facilitate quick and thorough decontamination of people, animals, vehicles, or other things in the event of an emergency. The gate is formed by liquid conduits connected together, and numerous spray heads positioned along the conduits.

BACKGROUND OF THE INVENTION

In society today there exists the potential for persons to be exposed to a variety of hazardous materials, whether by the intentional acts of others, or by accident. In the event of exposure to hazardous materials, decontamination and evacuation of persons and equipment becomes a priority. Exposed persons should be decontaminated as soon as possible to minimize the risk to their health. In addition, equipment must be decontaminated as soon as possible to protect the safety of persons using the equipment. Also, any exposed animals need to be decontaminated and evacuated as well.

History has shown that places where large crowds of people gather have been targets for attack. Today, there are a large number of places that can attract large numbers of people. These include, but are not limited to, concerts, sporting events, speeches, political rallies, state fairs, etc. Each of these events has proven to have the potential to draw large crowds of people and therefore the interest of terrorists. For example, there can be as many as two hundred thousand people at a race track during a race event. In addition to threats from terrorism, accidents have the potential to expose a large number of people to hazardous material. If an exposure occurs at one of these large gatherings, it is difficult to decontaminate all the people and equipment in a timely fashion using the current technique. Currently, in the event of an exposure, people and objects must be decontaminated, and the authorities, specifically the fire departments, which are ordinarily the first responders, have two main objectives. First, all people and objects exposed to the hazardous material need to be decontaminated, and second, the people and things need to be moved out of the affected area.

At the present time, decontamination is accomplished by rinsing with water. If in the future, a new liquid is developed that better decontaminates, the present invention will allow its use. Currently, decontamination of people and objects is accomplished by moving two fire trucks as close to the affected area as possible, turning nozzles attached to the trucks toward each other, commencing a flow of water to form a shower, and moving the exposed people and objects between the trucks while rinsing them with water. There are several problems with this method. First, fire trucks are typically large vehicles, and it is difficult to maneuver them through large crowds of people. Second, people need to be moved into the area of the fire trucks in order to pass between them and the sprays. Then, after being decontaminated (sprayed with water by the fire trucks), the decontaminated people need to be evacuated from the affected area so the remaining people and equipment can be decontaminated. This is especially difficult when people are confused and scared as they are frequently after exposure to hazardous material. Peoples's confusion adds to the difficulty of decontaminating and evacuating in a speedy and efficient manner.

One potential solution to these problems available at present is to take tents that form showers to the affected area. However, these tents are both heavy and awkward to move, requiring a vehicle to move them for any distance. Therefore these vehicles experience the same problems in movement as the fire trucks. Also, it takes time either to line up the fire trucks or to set up these portable tents. Decontamination can not begin until the trucks are in place or the tents are set up. The longer it takes to decontaminate persons exposed to hazardous material, the more dangerous the exposure becomes. Because of the limitations of the current methods, decontaminating large numbers of people and objects exposed to hazardous material is slow, inefficient, and in need of improvement.

The present invention solves these problems. Most of today's large venues and gathering areas have some means of controlling public access and egress. Usually this involves the venue or area being enclosed by a wall or fence. Access to the public in and out of the venue or area is restricted by the use of gates. As a result, people enter and exit only in certain places. The present invention (hereinafter called "watergate") is intended to be used in place of the typical gate. Unlike the tents and fire-trucks used for decontamination now, the watergate is always in place and is always ready for use. It does not have to be carried to the affected area; it is already there. The watergate is superior to the present art because it accomplishes two main objectives at the same time. In a venue or area equipped with an operating watergate, people exposed to hazardous material are decontaminated and evacuated from the affected area simultaneously. With the watergate in operation, people are decontaminated and evacuated simply by moving through the activated watergate. Also, because people can be decontaminated and leave the area the same way they came in, they are less likely to be confused and more likely to be decontaminated and evacuated in a speedy and efficient manner. As a result, decontamination proceeds at a faster rate thereby minimizing the potential harm from extended exposure to the hazardous material.

In addition to its decontamination properties, the watergate also functions as a security gate. Like any other gate, the watergate opens, closes, and has locking abilities. It simply replaces the existing gate. The only additional, necessary component to the watergate is a water connection. This can be done by any available conventional means; even something as simple as a hose would suffice. Also, the watergate can be made to various specifications and out of many different materials. This allows the watergate to blend in and match the fence or walls already in place at any stadium, ball park, amusement park, military installation, government facility, arena, race track, industry, or any other place where a large number of people may gather. However, once opened and unfolded the watergate becomes a decontamination corridor. The watergate can be made to any size to accommodate people, vehicles, animals, or any other object needing to pass through it. It can have a variety of different types of nozzles for different volumes of liquid and different pressures. It can have different amounts of nozzles to meet the desired coverage area. The watergate can even be equipped to spray liquids other than water. It is simply a matter of providing a source of a different liquid and pumping it through the conduits. It is readily apparent that the various embodiments of the present invention provide a superior security and decontamination system that overcome the drawbacks of the prior art.

DESCRIPTION OF THE PRIOR ART

Applicant is aware of the following U.S. patents concerning decontamination devices and systems:

| U.S. Pat. No. | Issue Date | Inventor | Title |
|---|---|---|---|
| 6,554,013B2 | Apr. 29, 2003 | Brown | TRANSPORTABLE COLLECTIVE PROTECTION SYSTEM |
| 6,470,512B1 | Oct. 29, 2002 | Lau, et al. | OPTIMIZED SHOWER ARRANGEMENT FOR HIGH VOLUME USE |
| 6,446,277B1 | Sep. 10, 2002 | Blomet | HIGH-CAPACITY METHOD AND SYSTEM OF CHEMICAL AND/OR RADIOLOGICAL DECONTAMINATION |
| 4,858,256 | Aug. 22, 1989 | Shankman | CHEMICAL EQUIPMENT DECONTAMINATION TRUCK |
| 3,288,109 | Nov. 29, 1966 | Smith, et al. | CAR WASH APPARATUS |

Applicant is aware of the following published patent applications concerning decontamination devices and systems:

| Pub. No. | Pub. Date | Inventor | Title |
|---|---|---|---|
| 2003/0074845 | Apr. 24, 2003 | Sample, et al. | PORTABLE DECONTAMINATION SYSTEM |
| 2003/0037812 | Feb. 27, 2003 | Stewart, et al. | DECONTAMINATION AND CONTAMINANT PROCESSING SYSTEM AND METHOD |
| 2002/0021985 | Feb. 21, 2002 | Peterson, et al | ELECTROSTATICALLY CHARGED AEROSOL DECONTAMINATION SYSTEM AND METHOD |

Each of these patents and publications teaches a decontamination or washing system, but none of them teach a combination security gate and decontamination system.

SUMMARY OF THE INVENTION

The invention provides apparatus for decontaminating persons and objects, and securing and limiting access to specific areas. The invented apparatus consists of a movable gate made of liquid conduits with spray nozzles positioned along the conduits. During normal operation, the apparatus functions as a normal gate. It opens, closes, and can be locked. When activated for decontamination, the gate is unfolded and opened, creating a series of overhead spray projections. Liquid, usually water, is then pumped into the gate and sprayed out of the numerous nozzles located along the gate uprights and the overhead projections. This spray forms a decontamination corridor for persons and objects to move through. The invention is particularly useful for decontaminating large crowds at venues and areas where access and egress are controlled by providing only certain places for entrance and exit.

OBJECTS OF THE INVENTION

The principal object of the present invention is to provide apparatus for decontaminating and evacuating persons and objects after exposure to hazardous materials, particularly in areas where large numbers of people and objects would be present.

Another object of the invention is to provide security by controlling access and egress, specifically by functioning as a gate.

BRIEF DESCRIPTION OF THE DRAWINGS

The foregoing and other objects will become more readily apparent by referring to the following detailed description and the appended drawings in which.

DETAILED DESCRIPTION

Figure 1:
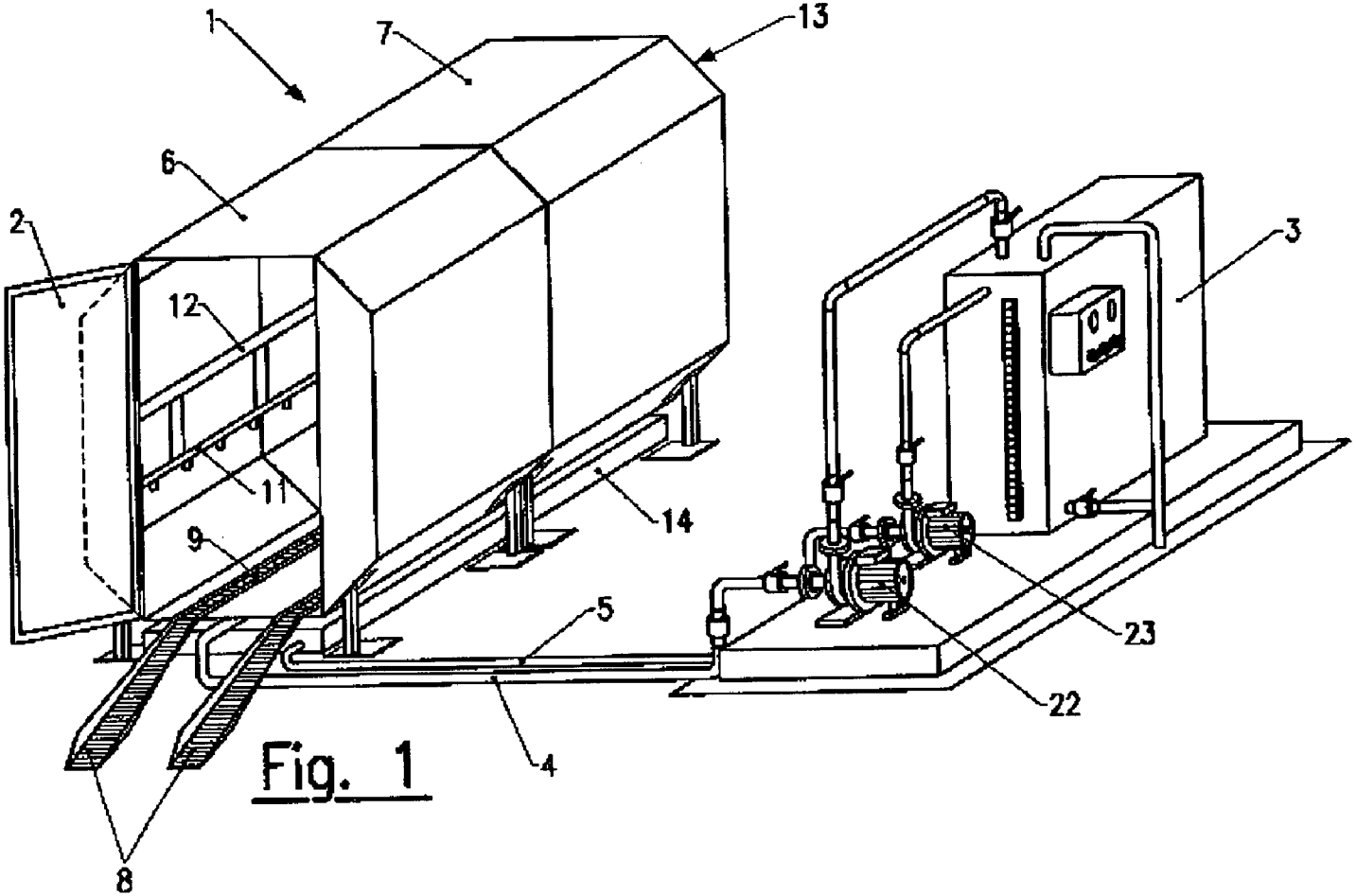
FIG. 1 is a side view of one embodiment of a single gate segment of the present invention. A solid liquid conduit is formed to create an upright and overhang from which liquid is sprayed.

Referring now to the drawings, and particularly to the embodiment of the invention shown in FIG. 1, the invented gate apparatus has an attachment means, typically a hinge 10 for mounting on an adjacent upright surface. In addition to supporting the gate, the hinge 10 is hollow allowing communication between a source of liquid and the hollow hinge 10. wherein the hollow hinge can be any variation of a sealed hollow shaft pivoting on a bearing where the hollow shaft can convey a liquid, thereby allowing the hollow hinge 10 to act as a liquid distributor to the liquid conduit 12 which forms the gate. The liquid conduit 12, which attaches to the hinge 10, is shaped to form an overhang. Spray nozzles 14 are positioned at intervals along the liquid conduit 12 from its base to its top.

Figure 2:
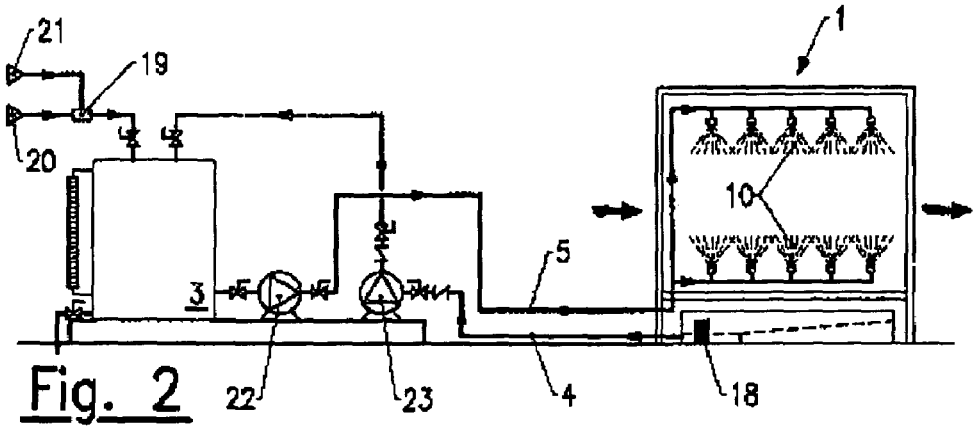
FIG. 2 is a side view of one embodiment of a single gate segment of the present invention. A first array of liquid conduits is rotated up and away from an upright array of liquid conduits to optimal spraying position.

In the embodiment illustrated in FIG. 2, the liquid conduit is segmented and is provided with a hinge 16 located at the top end of the upright liquid conduit 12, which connects the upright liquid conduit 12 to a communicating liquid conduit 20 that is pivotable with respect to the upright liquid conduit 12. The pivotable liquid conduit 20 can rotate from a standby position (flush against the upright liquid conduit 12) to an operative position (extended outward and upward creating an overhang) by means of the pivot hinge 16. A fluid connector 18 is located at the hinge end of the upright liquid conduit 12 and the hinge end of the rotatable liquid conduit 20 to facilitate transferring liquid from the upright liquid conduit 12 to the rotatable liquid conduit 20. Spray nozzles 14 are situated along both the upright liquid conduit 12 and the rotatable liquid conduit 20. There can be any desired number of spray nozzles 14 depending on the desired liquid coverage area.

Figure 3:
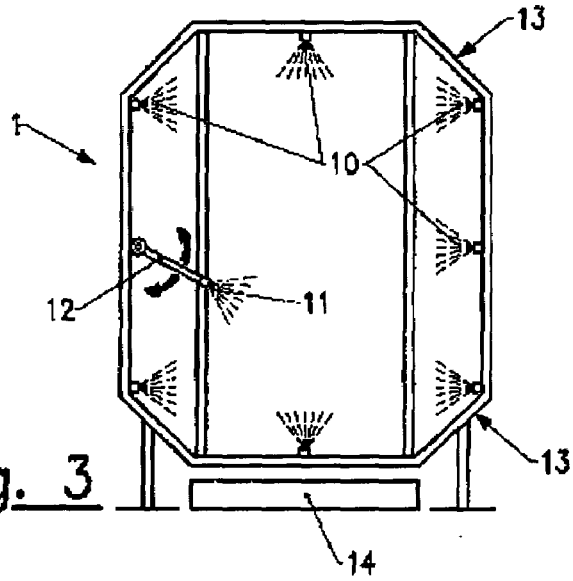
FIG. 3 is a side view of the gate of FIG. 2 in standby position.
Figure 4:
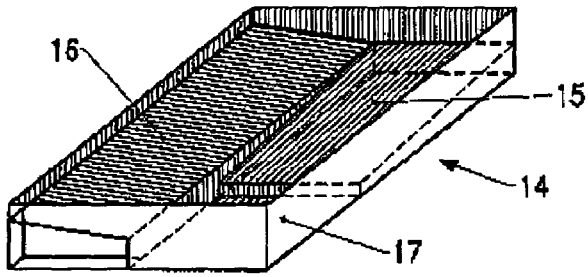
FIG. 4 is a front view of the gate of FIG. 2 in standby position showing a plurality of liquid conduits.

FIGS. 3 and 4 show the gate apparatus embodiment of FIG. 2 in the standby position. FIG. 3 is a side view of the gate apparatus showing the rotatable liquid conduit 20 in the down position so it is flush against the upright liquid conduit 12. The hinge 16 and the fluid connector 18 are visible at the top of the upright liquid conduit 12. In FIG. 4, the rotatable liquid conduits 20 are visible, but the upright liquid conduits 12 are hidden behind the rotatable liquid conduits 20. Also visible in FIG. 4 are horizontal liquid conduits 22 that support the rotatable liquid conduits 20. The horizontal liquid conduits 22 that support the upright liquid conduits 12 are not visible in FIG. 4, as they are hidden behind the horizontal liquid conduits 22 supporting the rotatable liquid conduits 20. The hinge 16 and the fluid connector 18 are both visible at the top of the rotatable liquid conduits 20. As can be readily appreciated from FIG. 4, there can be any number of upright and rotatable liquid conduits depending on the desired size of the gate.

Figure 5:
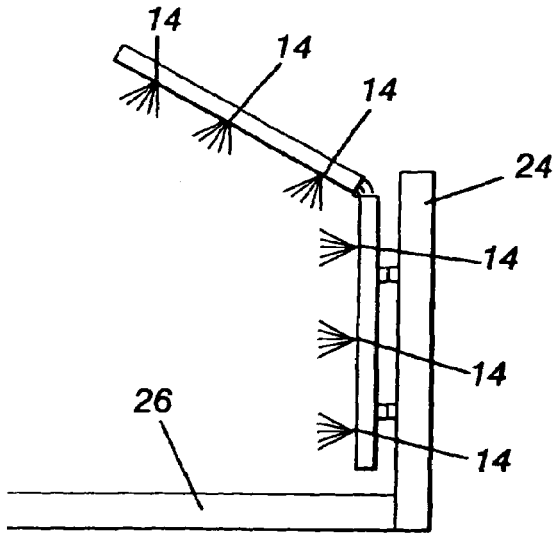
FIG. 5 is a front view of the gate of FIG. 2 in optimal spraying position attached to a support wall which is mounted on a base.

FIG. 5 shows the liquid conduit mounted on wall 24. The wall 24 is connected to the upright liquid conduits 12 by means of a hinge 10. The hinge 10 is formed to be a liquid connector for the transfer of liquid from a source to the liquid conduits 12. The wall 24 is connected to base element 26. FIG. 5 is a front view of the gate apparatus as in FIG. 2 in operative spraying position where the multitude of spray nozzles 14 can be seen.

Figure 6:
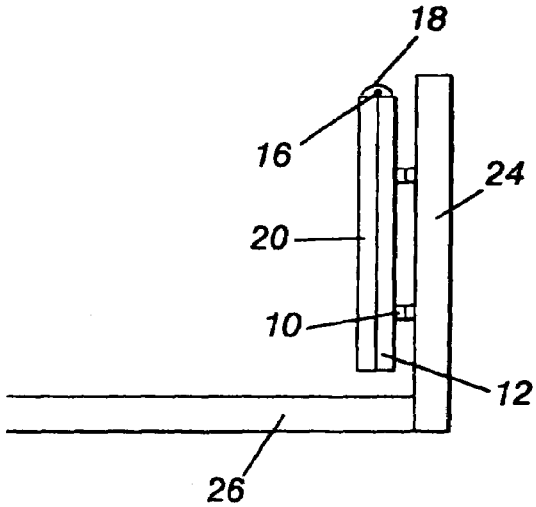
FIG. 6 is a front view of the gate of FIG. 5 in standby position rotated flush against a support wall.

FIG. 6 shows the gate apparatus with the rotatable liquid conduits 20 rotated to be flush against the upright liquid conduits 12 in the standby position, hiding the spray nozzles 14.

Figure 7:
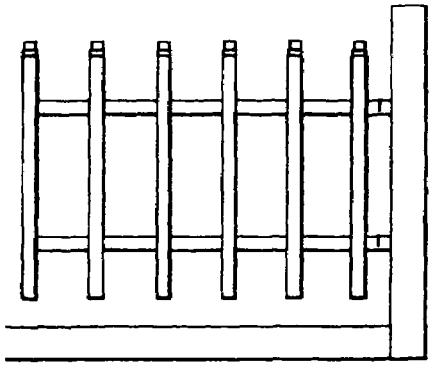
FIG. 7 is a front view of the gate of FIG. 5 in standby position rotated away from the support wall to form a barrier.

FIG. 7 shows the gate apparatus in security mode with the conduits rotated out away from the wall 24 in standby position forming a barrier.

Figure 8:
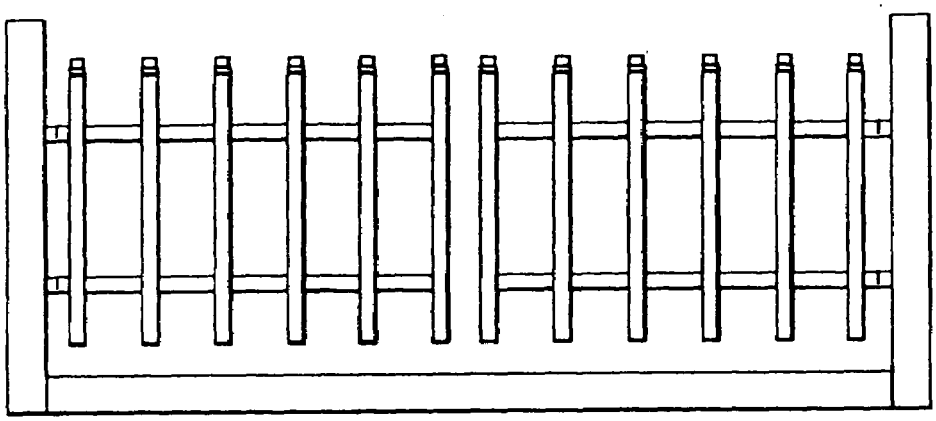
FIG. 8 is a front view of the preferred embodiment in which a pair of cooperating gates are shown in standby position rotated away from the support walls forming a barrier.
Figure 9:
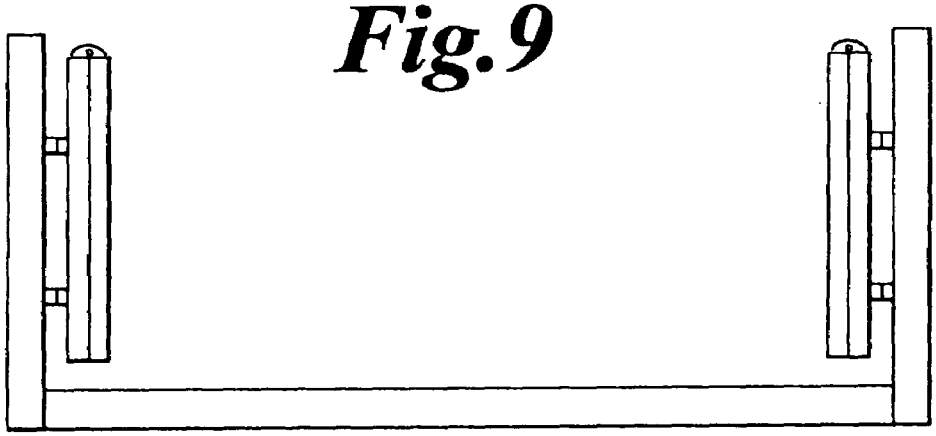
FIG. 9 is a front view of the gates in FIG. 8 in standby position rotated flush against the support walls.

FIGS. 8, 9, 10, 11, and 12 show the preferred embodiment of the decontamination gate apparatus. FIG. 8 is a front view of the gate apparatus in which a pair of gates are placed in opposite relation to each other. The gates are in the standby position and are rotated away from the wall elements 24 to form a barrier. FIG. 9 shows the gate apparatus rotated flush against the wall elements 24 to allow access and egress through the intervening space.

Figure 10:
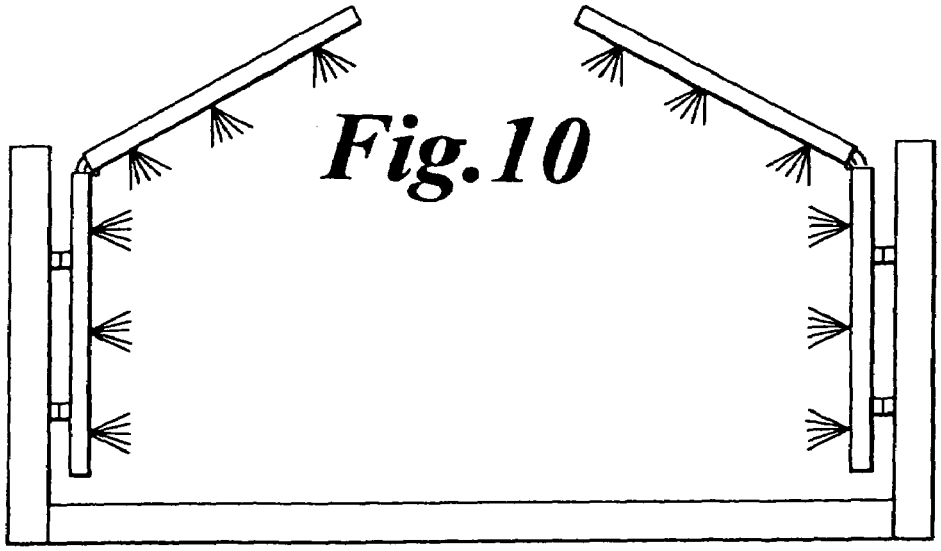
FIG. 10 is a front view of the gates of FIG. 8 in optimal spraying position facing each other and forming a decontamination corridor.

FIG. 10 is a front view of the preferred embodiment in which a pair of gates are shown in optimal spraying position facing each other and forming a decontamination corridor. The spray from the spray nozzles 14 can be adjusted so that the spray from one gate overlaps the spray from the opposite gate. This provides maximum liquid coverage for anything that passes between the gates.

Figure 11:
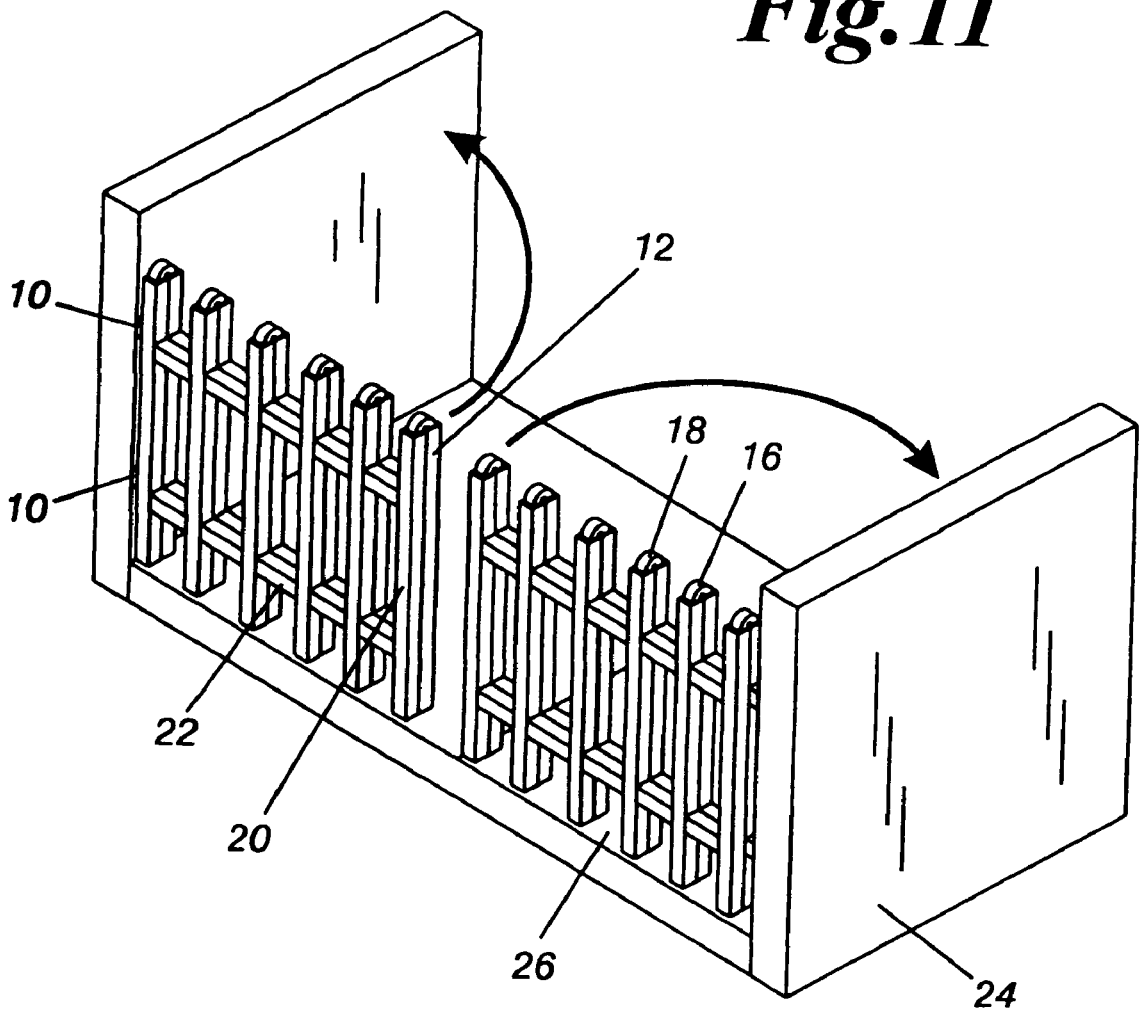
FIG. 11 is a perspective view of the gates of FIG. 8 in the closed position.
Figure 12:
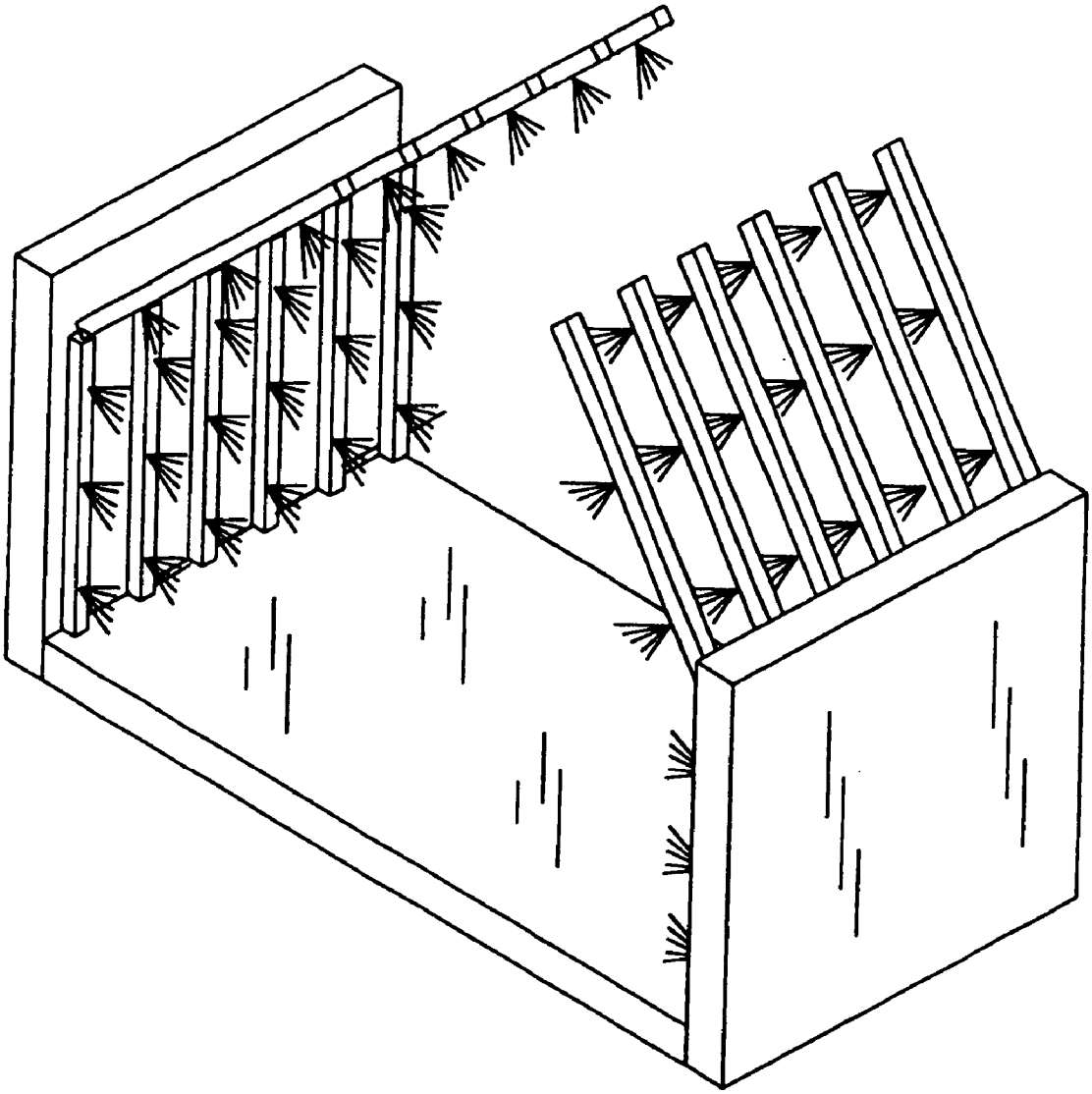
FIG. 12 is a perspective view of the gates in the spraying position, as in FIG. 10.

FIG. 11 is a perspective view of the gate in the barrier position. FIG. 12 is a perspective view of the gate in the operative position.

ALTERNATIVE EMBODIMENTS

It can be readily appreciated by those skilled in the art that there are numerous alternative embodiments of the present invention. For instance, many fences and walls are designed so the top has an overhang extending outward toward the exterior of the wall or fence. The present invention could do the same. A gate could be formed by a solid liquid conduit that extended vertically from near the ground upward and then bent outwardly toward the exterior of the conduit. Spray nozzles would be located at intervals along the conduit so that when activated liquid would spray horizontally from the lower portion of the conduit, and downwardly from the upper portion of the conduit. Also the conduit could be made in varying lengths and widths, and the amount of overhang could be adjusted to provide differing amounts of spray coverage.

The gate could also be manufactured as a complete portable unit that could be transported and temporarily placed at various locations. The gate would include a base and uprights supporting the movable portion of the gate. As a solid unit, the gate would need to be strong enough to allow it to be moved to various locations of a venue depending on what kind of event was taking place. The gate could be manufactured to different sizes and shapes depending on the desired location for its use. Also, the gate could be sized to fit on a truck for easy transportation to and from various locations.

Because of the nature of the gate, it could be mounted on a variety of surfaces. All that would be required from the mounting surface is the ability to support the weight of the gate and liquid when it was operating. The gate could be used as a single swinging gate for smaller areas or two gates could be used together to span a much wider area. Also, multiple gates could be used in tandem to provide a much higher volume of decontaminate. It is also possible that the gate could be mounted upside down so that when open, the gate would spray horizontally and upwardly. In this way the underside of vehicles could easily be decontaminated.

As is evidenced by the foregoing discussion, many alternative embodiments of the present invention can exist. Because of the versatility of the present invention, one skilled in the relevant art can readily appreciate many alternative embodiments, all of which are hereby contemplated.

SUMMARY OF THE ACHIEVEMENT OF THE OBJECTS OF THE INVENTION

From the foregoing, it is readily apparent that I have invented an improved method and apparatus for decontaminating persons and objects in response to exposure to hazardous materials, which accomplishes decontamination faster and more efficiently than heretofore has been possible.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A decontamination gate assembly for decontaminating persons and securing access to specific areas, said gate assembly comprising:

a) a vertical support member having an upright liquid conduit;

b) a first movable gate that swings horizontally and is pivotally attached to said support member via a hollow hinge, said movable gate in liquid communication with the upright conduit through the hollow hinge; said movable gate comprising:

(i) an array of elongated liquid conduits;

(ii) a plurality of spray nozzles arranged in spaced relationship on said array, where said spaced relationship directs the sprayed liquid toward person passing by the gate;

c) a source of liquid that provides liquid to the upright liquid conduit; and d) a lock for locking the first gate when the gate is closed.

2. The decontamination gate assembly according to claim 1, wherein each nozzle of said plurality of spray nozzles is selected to attain to effect decontamination of a person passing by the gate assembly.

3. The decontamination gate assembly according to claim 2, wherein said plurality of spray nozzles is arranged such that the sprays overlap.

4. The decontamination gate assembly according to claim 1, further comprising a second movable gate pivotally attached thereto, and positioned in opposite relation to said first movable gate, where said first and second movable gate can be locked.

5. The decontamination gate assembly according to claim 4, wherein the spray from said first gate is overlaps the spray from said second gate when the gates are open and folded back in opposite relation and liquid is spraying from the nozzles.

* * * * *